United States Patent [19]

Tammen

[11] 4,371,165

[45] Feb. 1, 1983

[54] TOP DICE ROULETTE GAME

[76] Inventor: Bobby J. Tammen, Rte. 2-Box 233, Colorado City, Tex. 79512

[21] Appl. No.: 275,142

[22] Filed: Jun. 18, 1981

Related U.S. Application Data

[62] Division of Ser. No. 175,146, Aug. 4, 1980, Pat. No. 4,299,592.

[51] Int. Cl.[3] ..... A63F 9/16

[52] U.S. Cl. ..... 273/147

[58] Field of Search ..... 273/147, 274

[56] References Cited

U.S. PATENT DOCUMENTS

| | | | |
|---|---|---|---|
| 1,374,243 | 4/1921 | Siegel | 273/147 |
| 1,546,451 | 7/1925 | Meyers | 273/147 |
| 2,573,916 | 11/1951 | Loveday | 273/147 |
| 2,794,644 | 6/1957 | Johnson | 273/147 |
| 3,982,763 | 7/1975 | Schlurensauer | 273/147 X |

FOREIGN PATENT DOCUMENTS

| | | | |
|---|---|---|---|
| 387831 | 1/1924 | Fed. Rep. of Germany | 273/147 |
| 551825 | 1/1923 | France | 273/147 |
| 400454 | 10/1933 | United Kingdom | 273/147 |

*Primary Examiner*—Harland S. Skogquist

*Attorney, Agent, or Firm*—Hubbard, Thurman, Turner, Tucker & Glaser

[57] ABSTRACT

A game of chance includes a game board with a plurality of sections thereon, wherein the sections are labeled with various indicia, or combinations thereof, and odds pertaining thereto. A chance indicator device for simultaneously selecting one such indicia and a game command. The device includes two sections rotatably joined together, wherein one section is friction fit about a shaft so that it cannot rotate relative thereto, and the other section is rotatably mounted to the shaft. Both sections are identically shaped so that they may be interchangeably mounted on the shaft either by themselves or in combination, one section containing indicia on its faces and the other section containing game commands on its faces. The device is spun on the game board so as to select the indicia and/or game commands.

1 Claim, 3 Drawing Figures

TOP DICE ROULETTE GAME

This is a division of application Ser. No. 175,146, filed Aug. 4, 1980 and now U.S. Pat. No. 4,299,592.

BACKGROUND OF THE INVENTION

1. Field of the Invention

This invention relates generally to games of chance. More particularly, the invention relates to a game board on which bets may be placed and a chance device for determining which bets, and what amounts, must be paid and by whom.

2. Description of the Prior Art

A number of games have been devised involving a game board with indicia and a chance device for determining which of the indicia are to be referred to in applying the game rules. However, most of these games are limited in the use of the game board to only one specific application and do not provide any flexibility in the choice of the game to be played. Those games which do not provide flexibility in game choice either necessitate complicated rule changes or require the use of a plurality of custom-made game materials, thus detracting from the ease of playing and/or adding to the cost of manufacture.

One possible cause of the above problems has been the use of a chance device with very limited flexibility in its applications to the game. Typically, either standard dice or some sort of spinning pointer device is used, neither of which have the capability of easy modification for another game. There are chance devices of the prior art that teach the use of two individual sections which could be rotated relative to each other. However, those devices do not provide for any interchangeability of the sections so that they could be used either in combination with one another or by themselves. Such limitations on the use of the chance device limit the number and kinds of games that could be played using both the game board and the chance device.

SUMMARY OF THE INVENTION

The principal object of the present invention is to provide a unique game of chance wherein betting skill, as well as chance, combine to determine the outcome of the game.

Another object of the invention is to provide a game board wherein multiple games are possible, depending upon the type of chance device utilized.

A further object of the invention is to provide a chance device which incorporates the use of two identically-shaped sections that can be interchangeably mounted on the chance device for singular use or in combination.

Yet another object of the invention is to provide a chance device wherein the component parts thereof are inexpensive to manufacture and easy to assemble in their various interchangeable positions.

The invention, accordingly, comprises a game board including a plurality of subsections wherein the subsections are labeled with a plurality of indicia, or combinations thereof, as well as odds which facilitate betting. The invention further comprises a chance member which may contain one section, or several sections in combination, for determining the outcome of the game.

Further features and objects of the invention will be apparent from an examination of the accompanying drawings which illustrate the invention.

BRIEF DESCRIPTION OF THE DRAWINGS

Similar reference characters refer to similar parts throughout the several views of the drawings.

DESCRIPTION OF THE PREFERRED EMBODIMENTS

Figure 1:
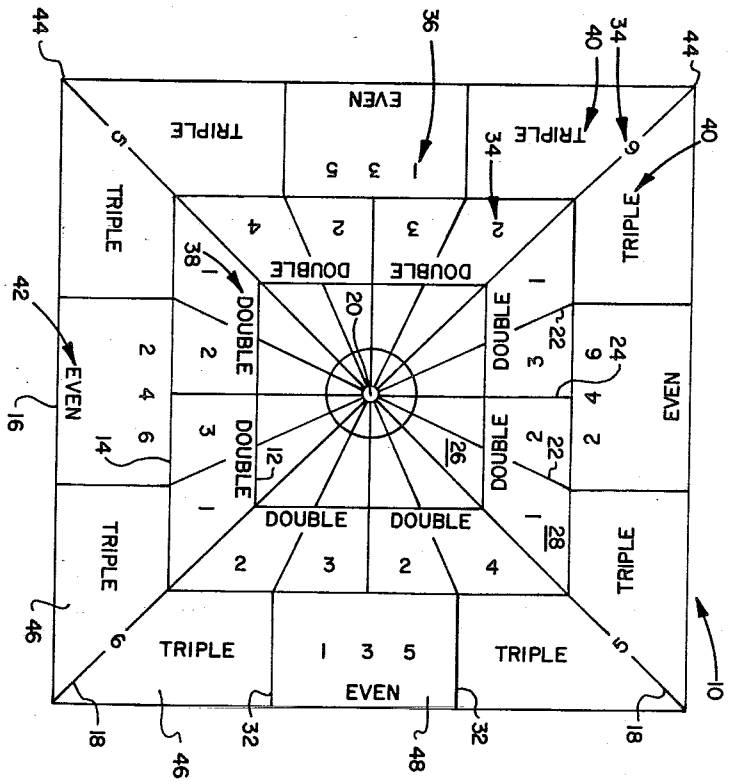
FIG. 1 is a top plan view of the game board showing the indicia and the odds labeled thereon.

Referring now to FIG. 1 of the drawings, a game board (10) is shown having thereon three concentric squares (12, 14, 16) of different sizes, each being divided into a plurality of subsections. The three squares (12, 14, 16) are shown sharing two common dividing lines (18) which pass through their four corners and cross at the center (20) of the game board (10), thus dividing each square (12, 14, 16) into four equal parts. The smaller two squares (12, 14) are shown having each of the their four equal parts further divided by three lines (22, 24) which extend from the center (20) of the game board (10) to three equally spaced locations along the side of the square (12, 14), thus forming sixteen subsections (26, 28) in each of the smaller two squares (12, 14). That portion of the larger square (16) which extends outside the two smaller squares (12, 14) is shown further divided into twelve subsections (46, 48), said subsections (46, 48) being formed by lines (32) which extend perpendicularly from the sides of the largest square (16) to the sides of the next smaller square (14), the lines (32) being located so that they meet the next smallest square (14) at the subsection dividing lines (22) which are on either side of its corners.

Each of the subsections (28, 46, 48) in the two largest squares (14, 16) is provided with one indicia (34), or a combination thereof (36), that is permanently affixed thereto in a balanced arrangement of locations which allows the players to easily reach at least one location of the desired indicia (34) or combination thereof (36), from any side of the game board (10). The game board (10) is shown having odds assigned to the subsections (28, 46, 48) of the two largest squares (14, 16), the odds being labeled (38, 40, 42) on the subsections (28, 30) in order to facilitate betting by the players.

One example of such an arrangement would be as follows: that portion of the second largest square (14) which extends outside the smallest square (12) has its subsections (28) labeled, going clockwise, with the numbers 1, 3, 2, 1, 4, 2, 3, 2, 1, 3, 2, 1, 4, 2, 3, 2, and with "DOUBLE" odds labels (38) connecting the combinations 1-3, 2-1, 4-2, 3-2, 1-3, 2-1, 4-2, 3-2; that portion of the largest square (16) which extends outside the next smaller square (14) has its corners (44) alternately labeled with the numbers 5 and 6, each of the numbers being bisected by the corner dividing lines (18), with the subsections (46) on either side of the corner dividing lines (18) being labeled by "TRIPLE" odds labels (40); the remaining subsections (48) being alternately labeled with the combinations (36) of 1-3-5 and 2-4-6, each also having the label "EVEN" (42) attached thereto.

Figure 2:
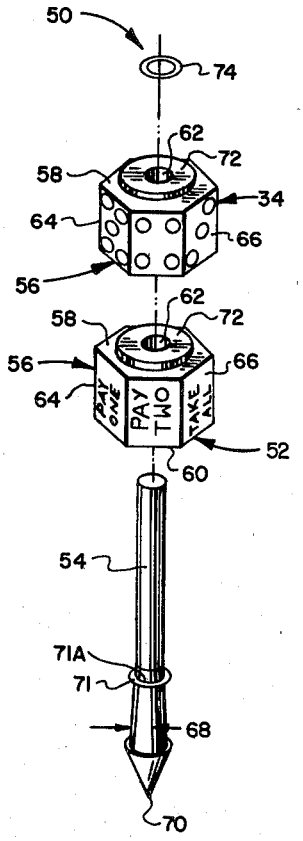
FIG. 2 is an exploded side view of the chance member of the invention.
Figure 3:
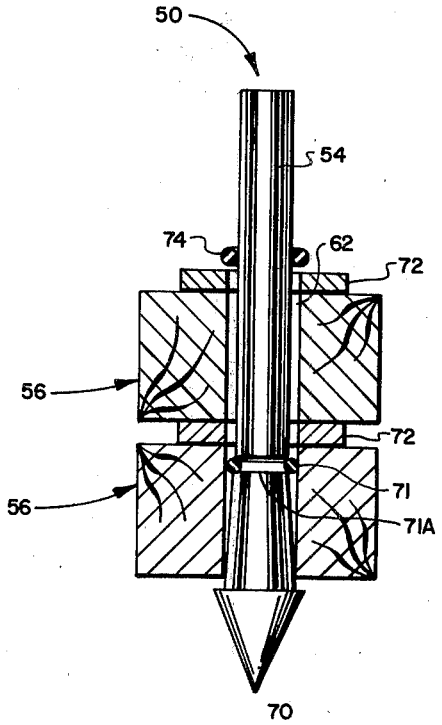
FIG. 3 is a side cross-sectional view of the chance member having both sections mounted thereon.

FIGS. 2 and 3 show a means for indicating the indicia (34) or game command (52) to be used when the player takes his turn spinning the means. The indicating means comprises a four-sectional top-shaped chance member (50) with a pointed shaft (54) which is spun on the smallest square (12) of the game board (10). The chance member (50) comprises two hexagonal-shaped sections (56) which are removably mounted on a shaft (54), each having a top (58), a base (60), a longitudinal bore (62), and a circumferential periphery (64). The circumferential periphery (64) is divided into six longitudinal faces (66) wherein each face (66) extends from the top (58) to the base (60). Each face (66) of one of the sections (56) contains one of the indicia (34) identically corresponding to those indicia (34) on the game board (10).

Along each face (66) of the other section (56) are contained six different game corners (52). These game commands (52) for the six faces (66) are: TAKE ALL; PAY ONE; PAY TWO; TAKE TWO; TAKE ONE; ALL PAY.

The shaft (54) extends through the longitudinal bore (62) of both sections (56), wherein the shaft (54) is of increasing radius (68) near the pointed end (70), providing a removable friction fit for the shaft (54) in the longitudinal bore (62) of one of the sections (56) so that the section (56) does not rotate about the shaft (54) when the chance member (50) is spun, thereby providing a sufficient mass near the pointed end (70) to give stability to the spinning chance member (50). An "O" ring spacer (71) is fitted about the tapered section of the shaft (54) and is received within an annular groove or detent (71A). The purpose of the "O" ring spacer (71) is to enchance the friction fit and ensure that the lower chance section (56) is in vertical alignment. The tops (58) of both sections (56) each have a washer-shaped spacer (72) permanently affixed thereto which facilitates freedom of rotation of one of the sections (56) when it is mounted on the shaft (54) so that its base (60) rests upon the top (58) of the other of the sections (56). A rubber O-ring or other resilient bushing (74) is shown friction-fitted around the shaft (54) above the second section (56) so that when the chance member (50) is spun, the second section (56) may rotate about the shaft (54) relative to the first section (56) without slipping off the shaft (54), the chance member (50) coming to a stop with a face-up indicia (34) and a face-up game command (58) which determine the immediate outcome of the spinning player's turn. Depending on the game being played, the use of a second section (56) may not be necessary, in which case the second section (56) may be removed from the chance member (50). The sections (56) are identically-shaped so that their mounting positions are interchangeable for singular use or in combination with each other.

A plurality of games may be played using both the game board and the spinning chance member (50), one of which is played as follows: each player places one ante in the smallest square (12) of the game board (10). Each player then spins the chance member (50) having both sections (56) mounted thereon. Ignoring the game commands (52), the player who spins the highest number on the numbered section (56) will be the first player to spin the chance member (50) during the game. The first player then spins the chance member (50). If, for example, the chance member (50) comes to a stop with the game command (52) PAY TWO and the number 5 face up, the spinning player will then have to place two antes on any one of the subsections (28, 46, 48) labeled with the number 5.

The players then all take turns, in rotation, at spinning the chance member (50). When the chance member (50) stops with the game command (52) TAKE TWO face up, the spinning player may then take two antes from any one of the subsections (28, 30) that is labeled with the number that corresponds to the face up number on the chance member (50). If there are not enough antes, in all of the subsections (28, 30) combined, which correspond to the number that is face up on the chance member (50), the spinning player will take as many antes as are available, up to the maximum of the game command (52) amount of TWO. Similarly, if the chance member (50) stops with the game command (52) TAKE ONE face up, the spinning player is allowed to take a maximum of one ante from any one of the subsections (28, 30) which is labeled with the same number that was face up on the chance member (50). Should the chance member (50) stop with the game command (52) ALL PAY face up, every one of the players has to place one ante in the smallest square (12) on the game board (50). If the chance member (50) stops with the game command (52) TAKE ALL face up, the spinning player may then take all of the antes which are on all of those subsections (28, 46, 48) that are labeled with the same number that is face up on the chance member (50).

When the players desire to end the game, the game command section (56) is ignored and the player who rolls the highest number will be the first to begin spinning the chance member (50) to end the game. Ignoring the numbered section (56), the players then take turns spinning the chance member (50) and paying into, or taking from, the smallest square (12) on the game board (10) as the game command (52) dictates. The game ends when the chance member (50) stops with the game command (52) TAKE ALL face up, the spinning player taking all of the antes that are on the entire game board (10).

Another game can be played as follows: one player is designated as the House. The House assignment may be for a specific player for a series of games, or may rotate from player to player as desired. The game command section (56) is removed from the chance member (50) so that only the numbered section (56) is used. The players may then place bets on any of the numbered subsections (28, 46, 48) of the game board (10). Whichever player who so desires may then spin the chance member (50) on the game board (10). If, for example, the chance member (50) stops with the number 2 face up, the House must pay to each betting player who placed a bet on the 2-4, 2-3, or 1-2 combination DOUBLE the amount of whatever his bet was. The House would also pay to each betting player who placed a bet on the 2-4-6 combination (36) an amount EQUAL to the amount of his bet. The House would then collect and keep all other bets that had been placed on the game board (10). The chance member (50) may then be passed to the next player who desires to spin it. All bets would thus be paid similarly, depending on the odds (38, 40, 42) labeled on the game board (10) which correspond to the bets placed whenever the chance member (50) stops with the applicable number face up.

Since obvious changes may be made in the specific embodiment of the invention described herein, such modifications being within the spirit and scope of the invention claimed, it is indicated that all matter contained herein is intended as illustrative and not as limiting in scope.

What is claimed is:

1. A chance member for simultaneously casting, a plurality of game commands and/or indicia comprising:

a shaft having one end pointed so that the chance member can be easily spun on said point;

two cylindrically-shaped sections removably mounted on said shaft, each having a top, a base, a longitudinal bore and a circumferential periphery;

wherein each said periphery is divided into a plurality of longitudinal faces, each face extending from said top to said base;

wherein one game command or one indicia is on each face of said sections;

wherein said shaft of said chance member is of increasing radius near the pointed end providing a removable friction fit for said shaft in the longitudinal bore of one of said sections so that said sections does not rotate about said shaft when said chance member is spun, thereby providing a sufficient mass near the pointed end to give stability to the spinning member;

wherein the tops of said sections each have a washer-shaped spacer permanently affixed thereto, which facilitates freedom of rotation of one of said sections when it is mounted on said shaft so that its base rests on the top of the other of said sections;

a means for removably and rotatably mounting the base of one of said sections, when a second section is desired to be used, to the spacer at the top of the other of said sections so that when the chance member is spun, the second section may rotate about said shaft relative to the first section without slipping off the shaft, the chance member coming to a stop with one face of each section directed face up;

wherein said mounting means includes a resilient annular bushing that is friction-fitted around said shaft above the second section; and wherein said sections are identically-shaped so that their mounting positions are interchangeable for singular use or in combination with each other.

* * * * *